US010390681B2

(12) United States Patent
Klusek et al.

(10) Patent No.: US 10,390,681 B2
(45) Date of Patent: Aug. 27, 2019

(54) DISHWASHER DOOR WITH MOVABLE DECORATIVE COVER

(71) Applicant: Whirlpool Corporation, Benton Harbor, MI (US)

(72) Inventors: Grzegorz Klusek, Wroclaw (PL); Sebastian Jan Chwalibog, Bielany Wroclawskie (PL); Jacek Kowalski, Kielczow (PL)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/636,876

(22) Filed: Jun. 29, 2017

(65) Prior Publication Data

US 2019/0000295 A1 Jan. 3, 2019

(51) Int. Cl.

| | |
|---|---|
| ***A47L 15/42*** | (2006.01) |
| ***A47B 96/00*** | (2006.01) |
| *A47B 96/20* | (2006.01) |

(52) U.S. Cl.

CPC ..... *A47L 15/4265* (2013.01); *A47B 96/00* (2013.01); *A47L 15/4257* (2013.01); *A47B 2096/208* (2013.01); *A47L 15/42* (2013.01)

(58) Field of Classification Search

CPC .. A47L 15/4257; A47L 15/4265; A47L 15/42; A47B 96/00

USPC ..... 312/228, 326, 311, 319.1, 319.2

See application file for complete search history.

(56) References Cited

U.S. PATENT DOCUMENTS

| | | | |
|---|---|---|---|
| 8,511,761 B2 | 8/2013 | Numanoglu | |
| 9,125,546 B2 | 9/2015 | Kleemann et al. | |

FOREIGN PATENT DOCUMENTS

| | | | | |
|---|---|---|---|---|
| CN | 203122330 U | | 8/2013 | |
| EP | 819404 | * | 1/1998 | ..... A47L 15/42 |
| EP | 1529482 A1 | | 5/2005 | |
| EP | 1875850 A1 | | 1/2008 | |
| EP | 1894509 B1 | | 3/2010 | |

(Continued)

OTHER PUBLICATIONS

European Extended Search Report for Counterpart EP 118179390.2, dated Nov. 23, 2018, 10 pgs.

*Primary Examiner* — James O Hansen

(74) *Attorney, Agent, or Firm* — McGarry Bair PC

(57) ABSTRACT

A dishwasher comprises a chassis having a base, a tub supported on the base and at least partially defining a treating chamber having an access opening, a door having a door height extending between a door upper end and a door lower end, a hinge pivotally mounting the door to the chassis for pivotal movement between a closed position, wherein the access opening is closed, and an opened position, wherein the access opening is opened, a non-racking decorative cover having a cover height extending between a cover upper end and a cover lower end; and a slide assembly mounting the decorative cover to the door to move the decorative cover upwardly from a retracted position to an extended position as the door is pivoted from the closed position to the open position. The decorative cover height is greater than the door height such that the decorative cover lower end lies below the door lower end supporting the dishwasher when the door is in the closed position such that extending the decorative cover prevents the decorative cover lower end from contacting the chassis when the door is moved from the closed to the open position.

15 Claims, 7 Drawing Sheets

(56) References Cited

FOREIGN PATENT DOCUMENTS

| | | | |
|---|---|---|---|
| EP | 2110064 | B1 | 3/2011 |
| EP | 2329758 | A1 | 6/2011 |
| EP | 2407723 | A1 | 1/2012 |
| EP | 2482703 | B1 | 3/2014 |
| EP | 2722621 | A1 | 4/2014 |
| EP | 2946714 | A1 | 11/2015 |
| WO | 2011039225 | A1 | 4/2011 |
| WO | 2011080236 | A1 | 7/2011 |
| WO | 2017021500 | A1 | 2/2017 |

* cited by examiner

DISHWASHER DOOR WITH MOVABLE DECORATIVE COVER

BACKGROUND OF THE INVENTION

Many consumers are influenced by design and style trends. This influence extends to living environments. For example, consumers often remodel one or more rooms in their homes, or buy new appliances simply because they appear "dated". For kitchen appliances, consumers often want updated appliances or appliances that match the kitchen cabinetry, which can help the appliance blend in with the cabinets. In this regard kitchen appliances, including refrigerators and dishwashers, are available that have decorative front covers that can be adapted or modified to match kitchen cabinetry.

SUMMARY

In an exemplary embodiment, a dishwasher comprises a chassis having a base, and a tub supported on the base and at least partially defining a treating chamber having an access opening. A door having a door height extending between a door upper end and a door lower end is pivotally mounted to the chassis for pivotal movement between a closed position wherein the access opening is closed, and an opened position wherein the access opening is opened. A decorative cover having a cover height extending between a cover upper end and a cover lower end is mounted by a non-racking slide assembly to the door to move the decorative cover upwardly from a lowered to a raised position as the door pivots from the closed position to the open position. The cover height is greater than the door height such that the decorative cover lower end lies below the door lower end adjacent to the floor when the door is in the closed position. As the door is moved from the closed to the open position, the decorative cover is raised to prevent the decorative cover lower end from contacting the chassis or the floor.

In another exemplary embodiment, a dishwasher door assembly comprises a dishwasher door having a door height extending between a door upper end and a door lower end. A decorative cover having a cover height extending between a cover upper end and a cover lower end, wherein the cover height is greater than the door height such that the decorative cover lower end lies below the door lower end. A non-racking slide assembly mounts the decorative cover to the door to move the decorative cover upwardly from a lowered to a raised position. The slide assembly comprises a left slide mounting a left side of decorative cover to the door and a right slide spaced apart and axially aligned with the left slide and mounting a right side of the decorative cover to the door. Each of the left and right slides moves synchronously between raised and lowered positions as the decorative cover moves relative to the door.

Yet another embodiment comprises a method of moving a decorative cover of a dishwasher door. The method comprises the step of rotating the dishwasher door from a closed to an opened position. As the dishwasher door is rotated, synchronously moving of opposing vertical sides of the decorative cover from a retracted position to an extended position prevent racking of the decorative cover.

DESCRIPTION

In exemplary embodiments of the disclosure, a dishwashing appliance has a dishwasher door with a non-racking decorative cover mounted thereon. The bottom of the decorative cover extends below the door, near the floor when the dishwasher door is closed. The decorative cover is slidingly mounted to the door and configured to slide as the door is opened (i.e., as the door moves from its closed position to its opened position) such that the bottom of the decorative cover moves (extends) toward the top of the door. Movement of the decorative cover prevents the bottom of the decorative cover from contacting the floor or the lower part of the dishwasher chassis when the door is opened. The decorative cover is also configured to slide back or retract when the door is closed (i.e., when the door moves from its opened position to its closed position) such that the bottom of the decorative cover moves (retracts) away from the top of the door, toward the floor. The decorative cover is arranged to retract enough so the bottom of the decorative cover is proximate the floor when the door is closed. The decorative cover can be mounted to the door with a plurality of sliders the synchronously move and stabilize the decorative cover relative to the door and to prevent it from twisting, turning, or jamming. There are a variety of ways to slidingly mount the non-racking decorative cover to the door, as will be described.

Figure 1:
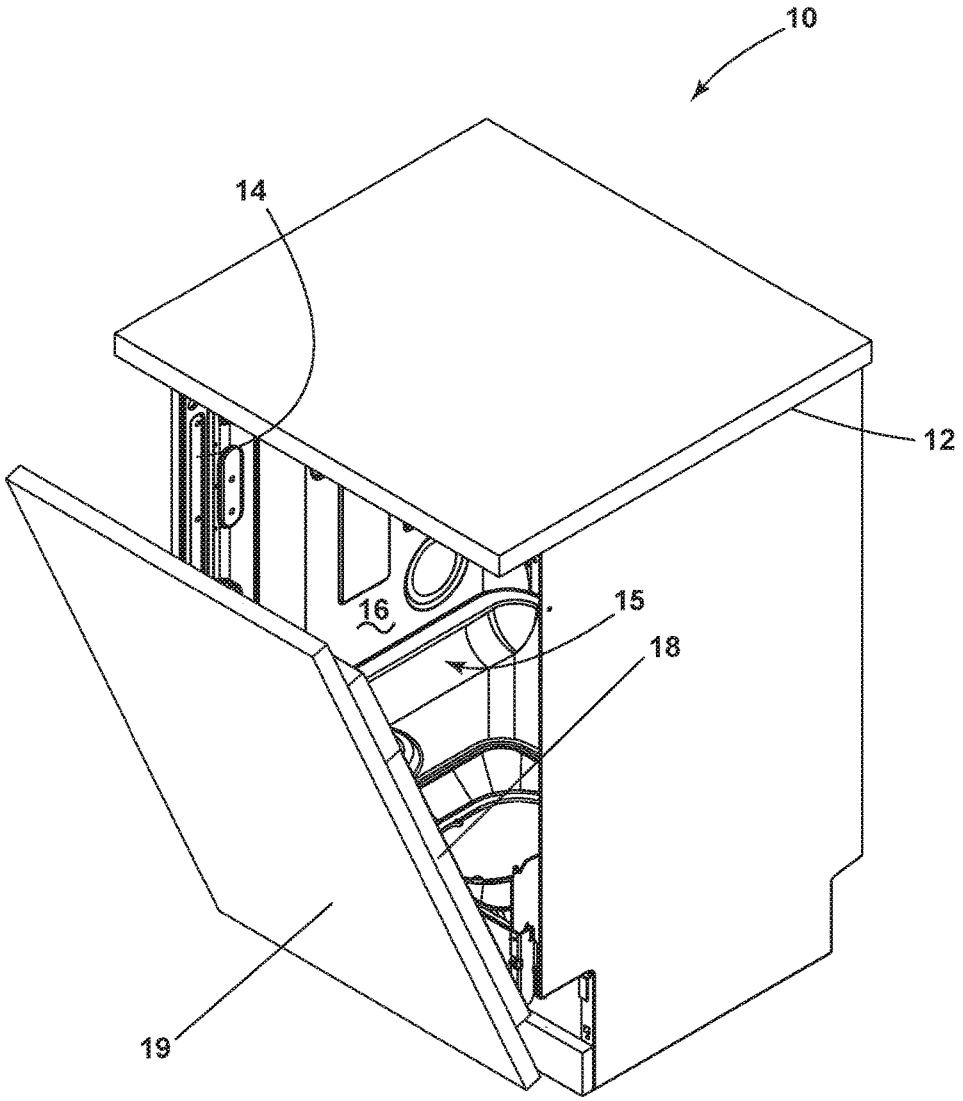
FIG. 1 is a perspective view of a dishwasher.

Generally, as shown in FIG. 1, an automated dishwasher 10 includes a decorative cover 19 slidingly mounted to a door 18. The dishwasher 10 shares many features of a conventional automated dishwasher, which will not be described in detail herein except as necessary for a complete understanding of the invention. An open-faced tub 14 can be provided within a chassis 12 and can at least partially define treating chamber 16, having an access opening 15 for washing dishes. A door 18 can be movably mounted to the dishwasher 10 for movement between opened and closed positions to selectively open and close the access opening 15 of the tub 14. Thus, the door 18 provides accessibility to the treating chamber 16 for the loading and unloading of dishes or other washable items. It should be appreciated that the door 18 can be secured to the lower front edge of the chassis 12 or to the lower front edge of the tub 14 via a hinge 23 (shown in FIG. 2) configured to pivot the door 18.

Figure 2:
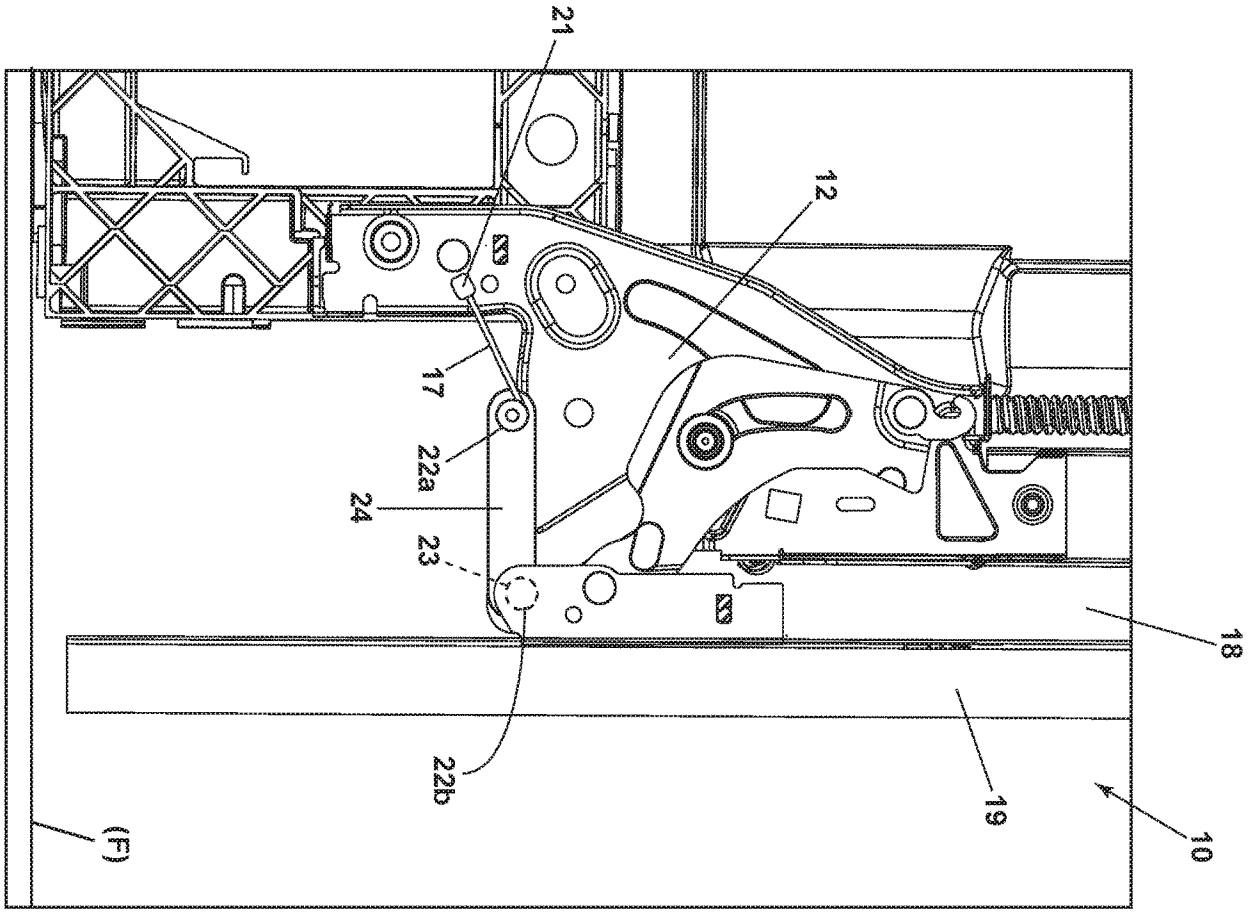
FIG. 2 is a side view of the bottom front of the dishwasher of FIG. 1, showing a rotatable arm mounted to the bottom of the door.

FIG. 2 is a side view of the bottom front of the dishwasher door 18 shown in a closed position, where the door 18 is hingedly coupled to chassis 12 by hinge 23 (shown in phantom). Decorative cover 19 is slidably coupled to door 18, and extends downward past the bottom of door 18 to near the floor (F) in a lowered position. The dishwasher 10 can include a tie 17 to move the decorative cover 19 with respect to the door 18. The tie 17 can be a string, rope, wire, monofilament line, or the like. One end of the tie 17 can be fixedly attached at one end to plate 21, which in turn is fixedly attached to chassis 12. An arm 24 can be fixedly coupled at one end to door 18 at or near hinge 23. A pulley 22*a* is affixed to arm 24 or door 18 concentric with hinge 23. The other (distal) end of arm 24 is spaced apart from the inside surface of door 18, and another pulley 22*b* can be affixed to the distal end of the arm 24.

Figure 3:
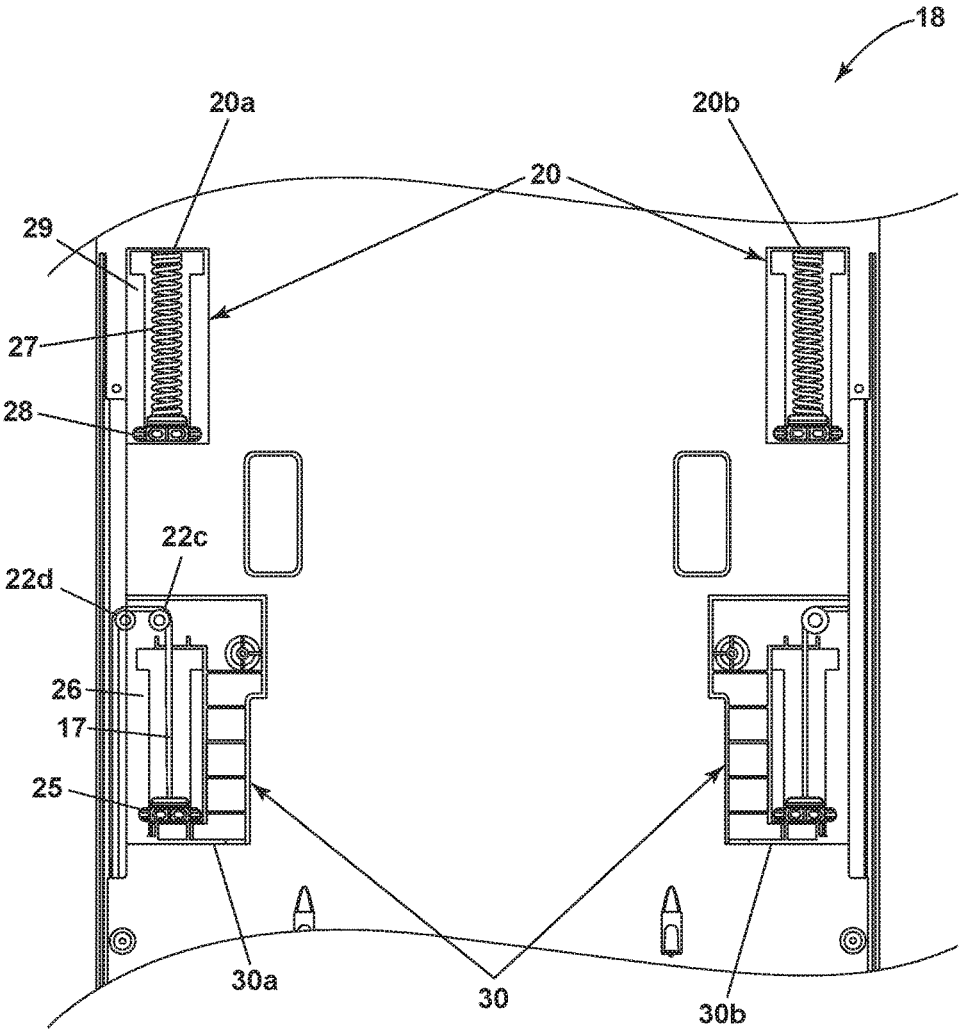
FIG. 3 is a dishwasher door in accordance with FIG. 1 illustrating upper and lower slide assemblies for mounting a decorative cover on the dishwasher door.

FIG. 3 is a partial front view of a surface of the dishwasher door 18. The door 18 has two upper slide assemblies 20 and two lower slide assemblies 30 which can be positioned between the decorative cover 19 and the door 18, and mounted to one or both of the decorative cover 19 and door 18. The two upper slide assemblies 20 can be horizontally aligned, or the two lower slide assemblies 30 can be horizontally aligned, or both. In other words, while not required, it is contemplated that four slider assemblies 20, 30 can attach to the decorative cover 19 to synchronously move and stabilize the decorative cover 19 relative to the door 18 and to prevent it from twisting, turning, or jamming. The term "non-racking" is used herein to mean that twisting, turning, and jamming of decorative cover 19 is prevented as decorative cover 19 moves relative to the door 18.

The upper slide assemblies 20 are made up of a left upper slide assembly 20*a* and a right upper slide assembly 20*b*. Each upper slide assembly 20*a*, 20*b* is generally identical in nature. Each upper slide assembly 20*a*, 20*b* comprises a slider 28 which moves on a slide track 29 which is fixedly coupled to door 18. The slider 28 is fixedly coupled to decorative cover 19 to allow the decorative cover 19 to move relative to the door 18. Each upper slide assembly 20*a*, 20*b* also has a damper or compression spring 27 that is affixed to door 18 at or near the top of slide track 29. The other end of spring 27 is affixed to slider 28.

Similarly, the lower slide assemblies 30 are made up of a left lower slide assembly 30*a* and a right lower slide assembly 30*b*. Each lower slide assembly 30*a* and 30*b* is generally identical in nature. Each lower slide assembly 30*a*, 30*b* comprises a slider 25 which moves on a slide track 26 which is fixedly coupled to door 18. The slider 25 is fixedly coupled to decorative cover 19 to also allow the decorative cover 19 to move relative to the door 18. The other end of tie 17 is affixed to slider 25 at or near the bottom of slide track 26. The tie 17 can extend from the slider 25 over pulley's 22*c*, 22*d* and can extend around pulley 22*a* and pulley 22*b* and fixedly attached at end plate 21 (as shown in FIG. 2).

In operation, when the door 18 is closed, arm 24 is generally perpendicular to the inside surface of door 18. The arm 24 rotates about hinge 23 as the door 18 pivots, moving the arm 24 from a generally horizontal position to a generally vertical position as the door 18 is opened. This causes the pulley 22*a* at the distal end of arm 24 to describe an arc around hinge 23, which pushes upward on tie 17 and causes a pulling force at the other end of tie 17 attached to slider 25. As the end of tie 17 pulls on slider 25, slider 25 is pulled up slide rack 26, which pulls decorative cover 19 to its extended position as door 18 moves from its closed position to its open position. Further, as door 18 is opened and slider 25 pulls decorative cover 19 to its extended position, slider 28 on upper slide assemblies 20 is also pulled in the upward direction, compressing spring 27 and causing it to push down on slider 28.

Conversely, when the door 18 is moved from the open position to the closed position, the arm 24 rotates about hinge 23 as the door 18 pivots, moving the arm 24 from a generally vertical position back to a generally horizontal position as the door 18 is closed. This causes the pulley 22*a* at the distal end of arm 24 to arc down relative to hinge 23. This would cause tie 17 to slack except that slider 28 is pushed down by the action of compression spring 27, thus taking up any slack. As a result, slider 28 pushes down on decorative cover 19, which pushes down on slider 25, and the decorative cover 19 returns to its retracted or lowered position.

It should be noted that non-racking stability of the movement of decorative cover 19 with respect to door 18 is enhanced because both ties 17 of lower slide assemblies 30 pull up on sliders 25 with equal force, and both springs 27 of upper slide assemblies 20 push down on sliders 28 with equal force, thus all four slider assemblies 20, 30 help stabilize movement of the decorative cover 19 with respect to door 18. In addition, it should be noted that the various springs 27, ties 17, and other elements of each slide assembly are not limited to the illustrations. The upper and lower slide assemblies 20, 30 could be reversed or the springs 27, ties 17, and other elements could be designed to be housed in one or more slide assemblies.

Figure 4:
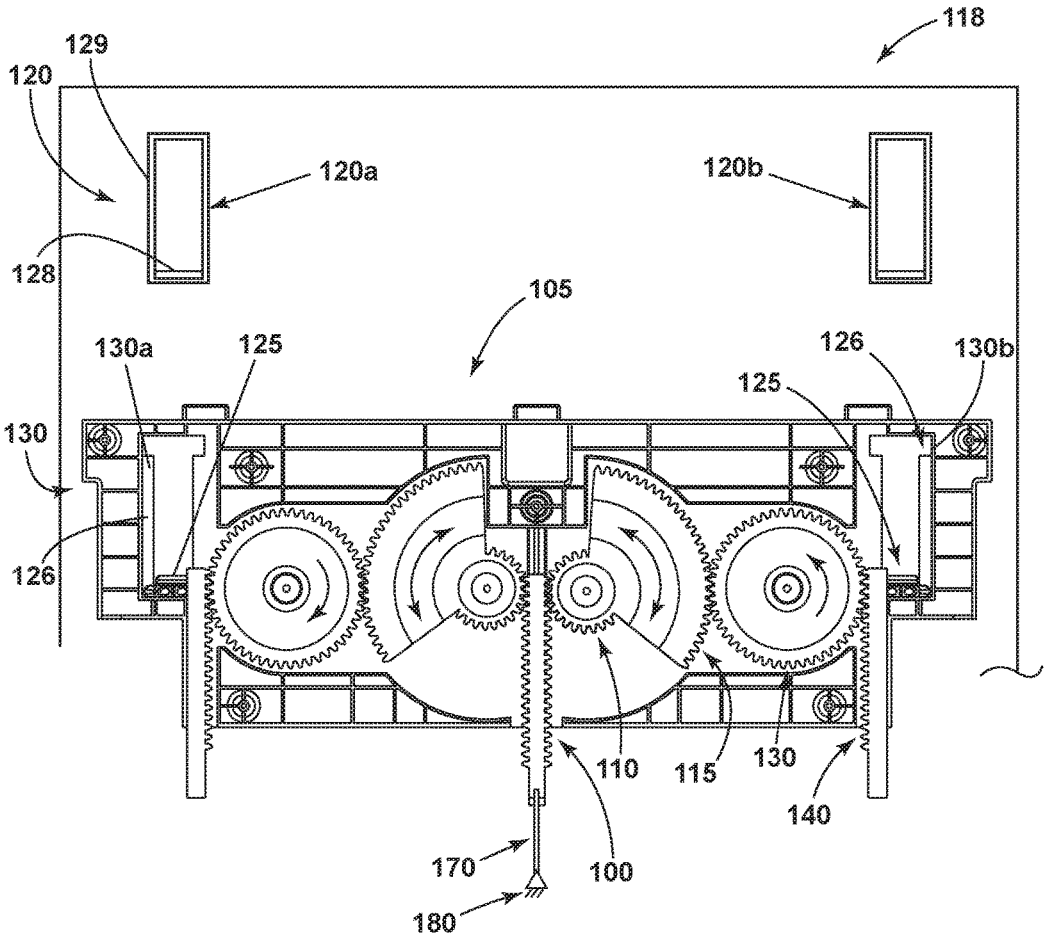
FIG. 4 illustrates another embodiment of a dishwasher door illustrating upper and lower slide assemblies and a gear train for mounting a decorative cover on the dishwasher door.

FIG. 4 shows an alternate embodiment of a dishwasher door 118 that has similarities with the dishwasher door 18 of FIGS. 2 & 3. Therefore, elements of the dishwasher door 118 that are similar to the dishwasher door 18 are labeled with similar part numbers using the prefix 100. Like the dishwasher door 18, the dishwasher door 118 comprises two upper slide assemblies 120 and two lower slide assemblies 130 for moving decorative cover 119 with respect to door 118.

The upper slide assemblies 120 are made up of a left upper slide assembly 120*a* and a right upper slide assembly 120*b*. Each upper slide assembly 120*a*, 120*b* comprises a slider 128 which moves on a slide track 129 which is fixedly coupled to door 118. The slider 128 is fixedly coupled to decorative cover 119 to allow the decorative cover 19 to move relative to the door 118.

The lower slide assemblies 130 are made up of a left lower slide assembly 130*a* and a right lower slide assembly 130*b*. Each lower slide assembly 130*a*, 130*b* comprises a slider 125 which moves on a slide track 126 which is fixedly coupled to door 118. The slider 125 is fixedly coupled to decorative cover 119 to also allow the decorative cover 119 to move relative to the door 118.

The dishwasher door 118 can also carry gear train 105 fixedly connecting lower left slide assembly 130*a* and lower right slide assembly 130*b*. The gear train 105 can comprise center rack 100, which is the driving force of the gear train 105. Pinion gear 110 is fixedly attached to concentric gear 115 having a greater radius than pinion gear 110. Connecting gear 130 can be positioned between concentric gear 115 and side rack 140. Side rack 140 is fixedly coupled to slider 125, which slides upward in slide track 126. Slider 125 is fixedly coupled to decorative cover 119. It is contemplated the gears 110/115, and 130 rotate about respective pins located at their respective axes of rotation, and the pins are fixedly coupled to door 118 and are configured to hold gears 110, 115, 130 in place.

The bottom of center rack 100 is operatively coupled to a stationary point 180 on the chassis 112 indicated by a triangle. Stationary point 180 is offset from the door's axis of rotation such that center rack 100 is pushed up and pulled down as the door is opened and closed, respectively. Stationary point 180 can be, for example, a distal end of an arm (not shown) fixedly mounted to chassis 112. In an embodiment, intermediate bar 170 is used to couple stationary point 180 to center rack 100. As shown, the top end of intermediate bar 170 is pivotally coupled to the bottom end of center rack 100, and the bottom end of intermediate bar 170 is pivotally coupled to stationary point 180.

In operation, as the door 118 is opened, intermediate bar 170 is pushed against the stationary point 180 on chassis 112, thus causing center rack 100 to move upward. Pinion gear 110 converts the linear motion of center rack 100 into rotational motion, in the clockwise direction on the right side, and counterclockwise on the left side. Concentric gear 115 drives connecting gear 130 in a counter-clockwise direction on the right side and clockwise on the left side. Connecting gear 130 drives side rack 140 upward. Side rack 140 being fixedly coupled to slider 125, pushes slider 125 upward in slide track 126, thereby pushing decorative cover 119 to its extended position when the door is moved from its closed position to its open position.

Conversely, as the door 118 is closed, intermediate bar 170 is against the stationary point 180 on chassis 112, thus causing center rack 100 to move downward. As the center rack 100 is moved downward, pinion gear 110 converts the linear motion of center rack 100 into rotational motion in the counterclockwise direction on the right side and clockwise on the left side. Concentric gear 115 drives connecting gear 130 in a clockwise direction on the right side and counterclockwise on the left side. Connecting gear 130 drives side rack 140 downward. Side rack 140 causes slider 125 to move downward in slide track 126, thereby pulling decorative cover 119 to its retracted position.

In the illustrated embodiment, a 25 mm movement of the center rack 100 is caused by an offset of 25 mm between the stationary point 180 and the door's axis of rotation, although other offsets can be used to provide greater or lesser movement of the center rack 100. Moreover, the ratios of the radii of gears 110/115, and 130 are such that a 25 mm movement of the center rack 100 causes an 80 mm movement in side racks 140 and in decorative cover 119. However, other gear radii ratios can alternatively be used to cause a lesser or greater movement of side racks 140 and decorative cover 119.

Figure 5:
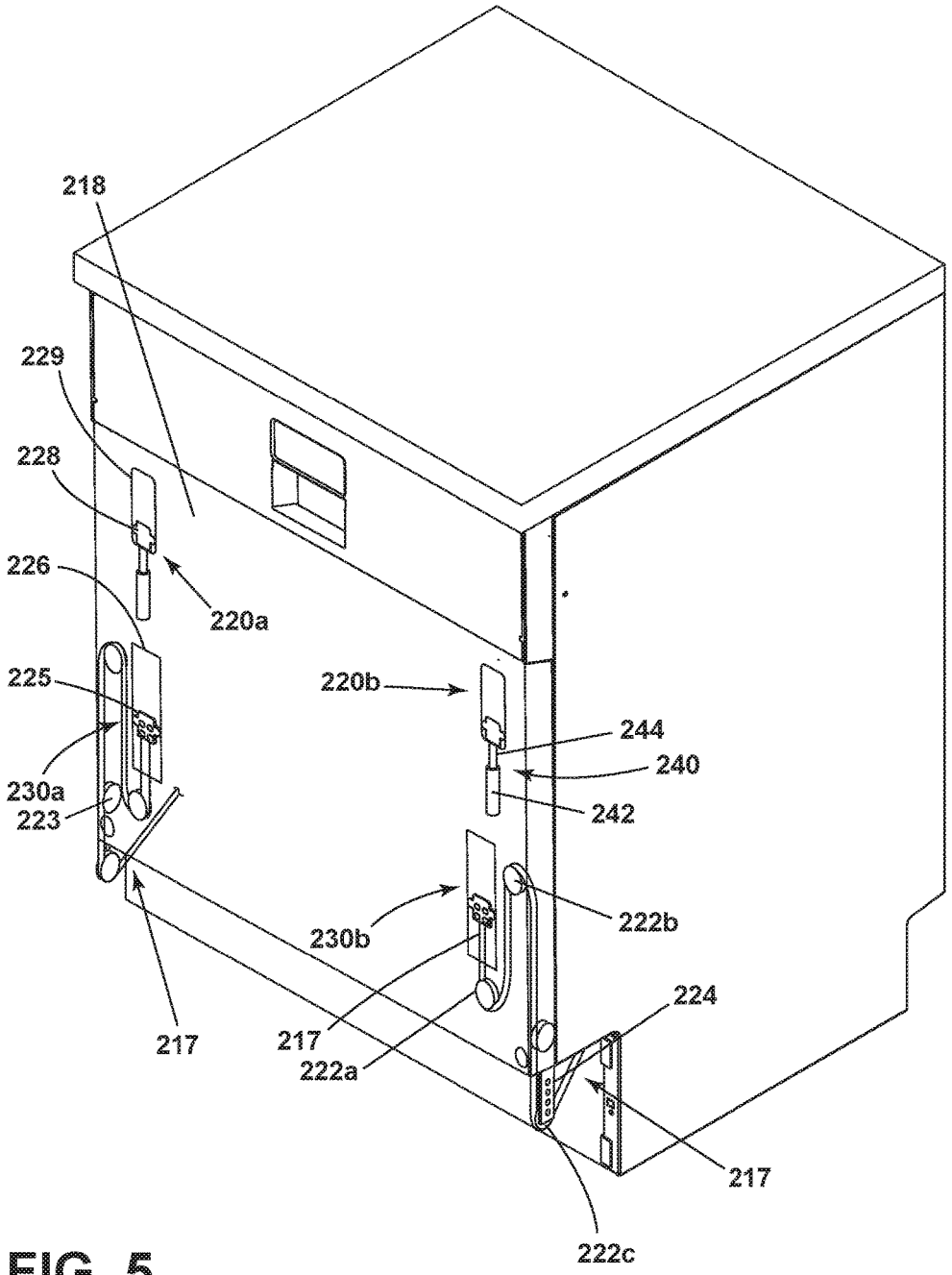
FIG. 5 is a perspective view of a dishwasher in another embodiment showing upper and lower slide assemblies and dampers for mounting a decorative cover on the dishwasher door.

FIG. 5 shows an alternate embodiment of a dishwasher door 218 that has also similarities with the dishwasher door 18 of FIGS. 2 & 3. Therefore, elements of the dishwasher door 218 that are similar to the dishwasher door 18 are labeled with similar part numbers using the prefix 200. Like the dishwasher door 18, the dishwasher door 218 comprises two upper slide assemblies 220 and two lower slide assemblies 230 for moving decorative cover 219 with respect to door 218.

As in the other embodiments, the upper slide assemblies 220 are made up of a left upper slide assembly 220*a* and a right upper slide assembly 220*b*. Each upper slide assembly 220*a*, 220*b* comprises a slider 228 which moves on a slide track 229 which is fixedly coupled to door 218. Each upper slide assembly 220*a*, 220*b* can comprise a piston-type damper 240 with a casing 242 mounted to one of the door 218 or the slider 228 and a reciprocating piston shaft 244 mounted to the other of the door 218 or slider 228.

The lower slide assemblies 230 are made up of a left lower slide assembly 230*a* and a right lower slide assembly 230*b*. Once again, each lower slide assembly 230*a*, 230*b* comprises a slider 225 which moves on a slide track 226 which is fixedly coupled to door 218. Each lower slide assembly 230*a*, 230*b* has a slider 225 affixed to one end of a respective tie 217. Each tie 217 can then follows a path around a pulley's 222*a*, 222*b*, around adjustable arm 224 carrying pulley 222*c* and affix to dishwasher chassis 212.

Figure 6:
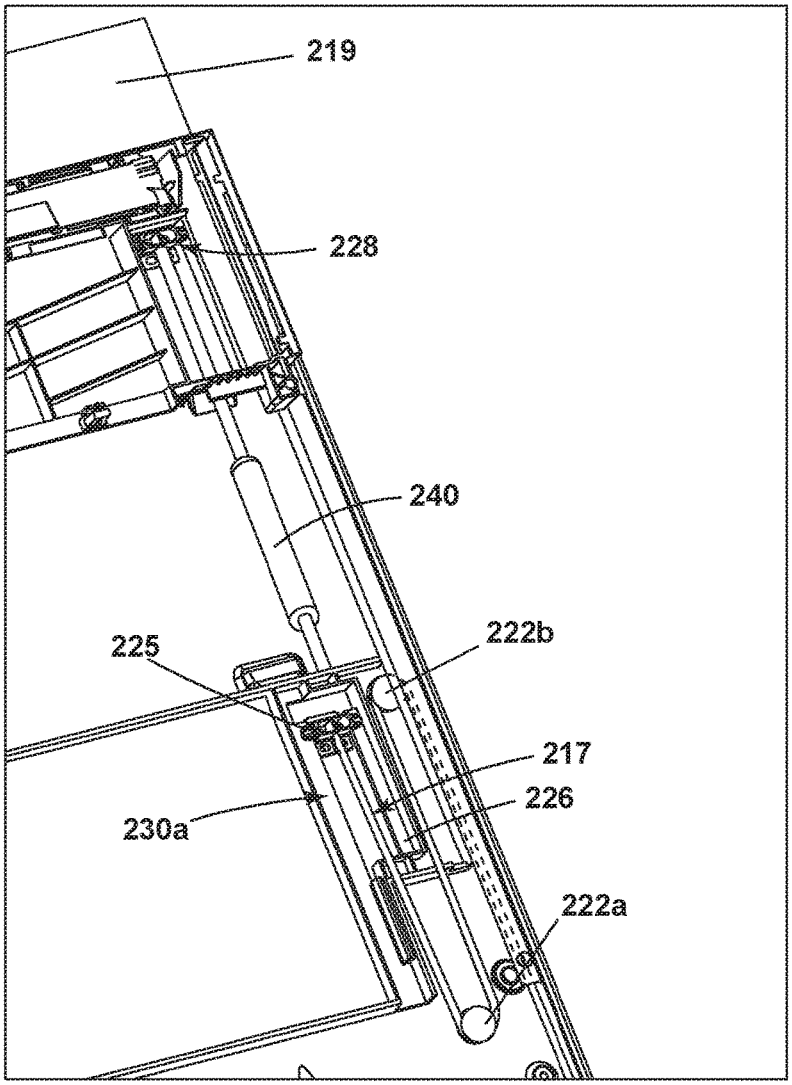
FIG. 6 is a top view of the dishwasher of FIG. 5 showing the door in an open position with the decorative cover extended.

FIG. 6 shows a partial view the door 218 of FIG. 5 after it has been moved to an open position. As shown, tie 217 is fixedly attached at one end to slider 225 of lower slide assembly 230*a*, which in turn is affixed to decorative cover 219. Tie 217 can run through pulleys 222*a*, 222*b* and 222*c* (shown in FIG. 5) and can be fixedly attached to the chassis 212 near the door hinge 223. Slider 225 slides along a slide track 226 and is fixedly attached to door 218.

In operation, when the door 218 is in the closed position, the damper 240 is compressed and has a natural tendency to push up on the slider 228. Tie 217 is taut and holds slider 225 in place, preventing the damper from pushing slider 228 upward. As the door is opened, adjustable arm 224 pivots around hinge 223, which would cause tie 217 to slack except that damper 240 is pushing up on slider 228, which pushes up slider 255, taking up any slack. Thus as damper 240 pushes slider 228 upward, decorative cover 219 is moved to its extended position as door 218 is opened.

Conversely, when the door 218 is moved from the open position to the closed position, the tie 217 pulls decorative cover 219 back to its retracted position. As the door 218 is closed, arm 224 pivots around hinge 223, moving the adjustable arm 224 from a generally horizontal position when the door 218 is open to a generally vertical position when door 218 is closed. As door 218 is closed, the distal end of adjustable arm 224 pushes down on tie 217 near its point of attachment to chassis 212. This causes the other end of the tie 217 to pull slider 225 down, thereby pulling decorative cover 219 also affixed to slider 228 to its retracted position.

Figure 7:
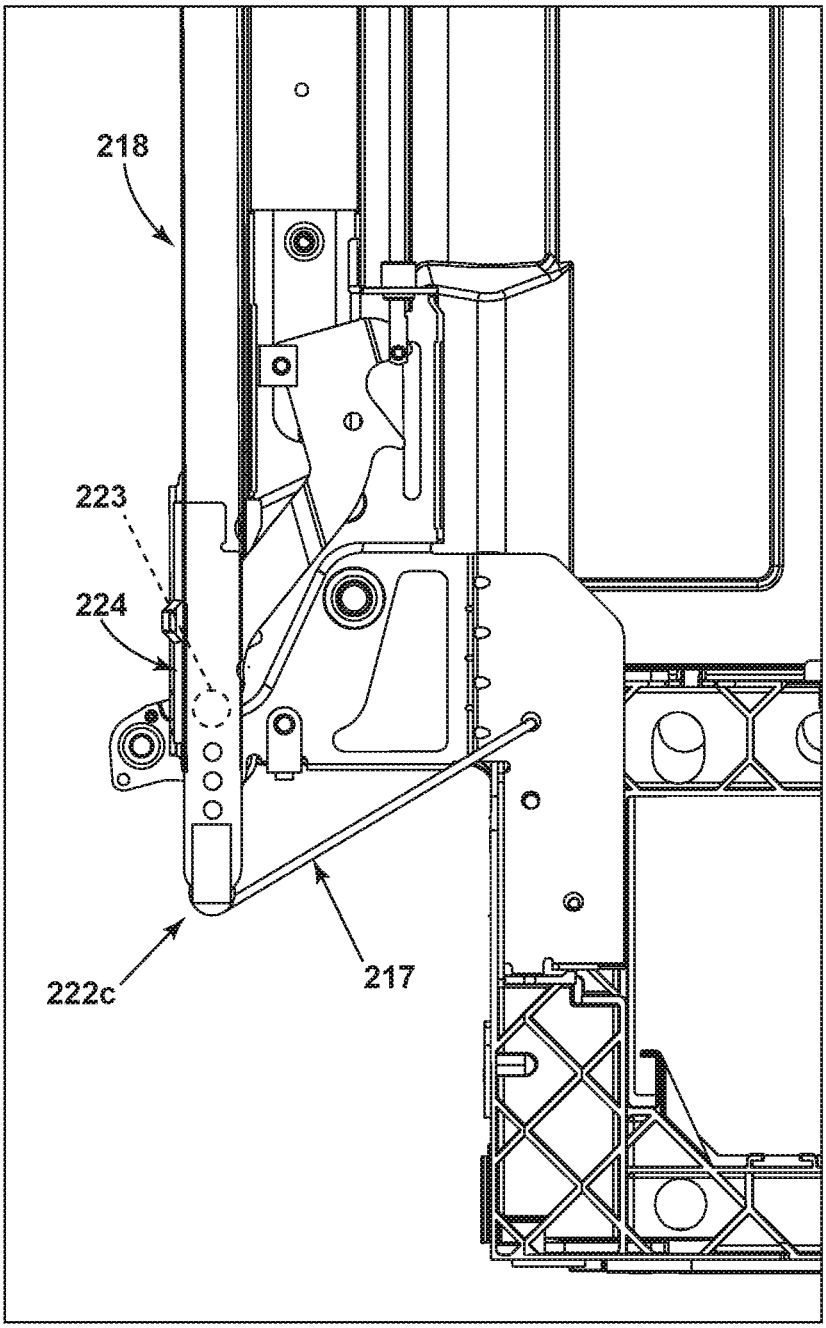
FIG. 7 is a side view of the bottom front of the embodiment of FIG. 6, showing detail of an adjustable arm.

FIG. 7 is a side view of the dishwasher 10 of FIG. 6 showing the adjustable arm 224. The distance from the bottom of door 218 to the distal end of arm 224 can be adjusted by removing a cotter pin, bolt, or other removable attachment means that secures arm 224 to the bottom of door 218. Adjustable arm 224 can then be moved up or down to a more favored position, and the attachment means can be used again to secure adjustable arm 224 in its new position to door 218. In this manner, the distance decorative cover 219 extends and retracts can be easily adjusted. In an exemplary operation, a long decorative cover 219 (e.g., 800 mm) can be installed on a shorter standard door (e.g., 720 mm). The long decorative cover can be used to improve the appearance of a dishwasher door, installed flashing, a plinth, or the like in a standard dishwasher. In an exemplary embodiment the distance decorative cover 219 moves between its extended position and its retracted position can be adjusted in a range from about 15 mm to about 85 mm.

Although the invention has been described and illustrated in exemplary forms with a certain degree of particularity, it is noted that the description and illustrations have been made by way of example only. Numerous changes in the details of construction, combination, and arrangement of parts and steps can be made without deviating from the scope of the invention. Accordingly, such changes are understood to be inherent in the disclosure. The invention is not limited except by the appended claims and the elements explicitly recited therein. The scope of the claims should be construed as broadly as the prior art will permit. It should also be noted that all elements of all of the claims can be combined with each other in any possible combination, even if the combinations have not been expressly recited or claimed.

What is claimed is:

1. A dishwasher comprising:

a chassis having a base;

a tub supported on the base and at least partially defining a treating chamber having an access opening;

a door having a door height extending between a door upper end and a door lower end;

a hinge pivotally mounting the door to the chassis for pivotal movement between a closed position, wherein the access opening is closed, and an opened position, wherein the access opening is opened;

a non-racking decorative cover having a cover height extending between a cover upper end and a cover lower end; and a slide assembly mounting the decorative cover to the door to move the decorative cover upwardly from a retracted position to an extended position as the door is pivoted from the closed position to the open position; the slide assembly comprising a tie having an first end, at least one upper slide assembly comprising a spring and at least one lower slide assembly comprising a first end of the tie; the at least one lower slide assembly also comprising a slider moveable on a slide track;

wherein the decorative cover height is greater than the door height such that the decorative cover lower end lies below the door lower end supporting the dishwasher when the door is in the closed position such that extending the decorative cover prevents the decorative cover lower end from contacting the chassis when the door is moved from the closed to the open position.

2. The dishwasher of claim 1 wherein the slide assembly includes a left slide mounting a left side of the decorative cover to the door and a right slide spaced apart from the left slide and mounting a right side of the decorative cover to the door.

3. The dishwasher of claim 2 wherein the left slide is a lower left slide that mounts the lower left side of the decorative cover and the right slide is a lower right slide that mounts the lower right side of the decorative cover.

4. The dishwasher of claim 3 further comprising an upper left slide mounting an upper left side of decorative cover to the door and an upper right slide spaced apart from the upper left slide and mounting an upper right side of the decorative cover to the door.

5. The dishwasher of claim 2 wherein the tie applies a pulling force to one of the left or right slides and wherein the spring biases the one of the left or right slides against the pulling force.

6. The dishwasher of claim 2 further comprising a rotatably arm and wherein rotational movement of the arm pulls one of the left or right slides to the extended position.

7. The dishwasher of claim 1 wherein the first end of the tie is affixed to the slider.

8. The dishwasher of claim 7 further comprising a pulley positioned above the slider.

9. The dishwasher of claim 8 wherein the tie comprises a second end and having a length between the first and second ends.

10. The dishwasher of claim 9 wherein the second end of the tie connects to the chassis.

11. The dishwasher of claim 1 wherein the spring is a compression spring.

12. A dishwasher comprising:

a chassis having a base;

a tub supported on the base and at least partially defining a treating chamber having an access opening;

a door having a door height extending between a door upper end and a door lower end;

a hinge pivotally mounting the door to the chassis for pivotal movement between a closed position, wherein the access opening is closed, and an opened position, wherein the access opening is opened;

a non-racking decorative cover having a cover height extending between a cover upper end and a cover lower end; and at least two slide assemblies mounting the decorative cover to the door to move the decorative cover upwardly from a retracted position to an extended position as the door is pivoted from the closed position to the open position; the at least two slide assemblies comprising at least one upper slide assembly comprising a compression spring and at least two lower slide assemblies comprising a tie and a slider moveable on a slide track; wherein a first end of the tie of each of the at least two lower slide assemblies is attached to the slider of each of two lower slide assemblies;

wherein the decorative cover height is greater than the door height such that the decorative cover lower end lies below the door lower end supporting the dishwasher when the door is in the closed position such that extending the decorative cover prevents the decorative cover lower end from contacting the chassis when the door is moved from the closed to the open position.

13. The dishwasher of claim 12 wherein the at least one upper slide assembly comprises two upper slide assemblies.

14. The dishwasher of claim 13 wherein each of the upper slide assemblies comprises a slider movable on a slide track and the compression spring is attached to the slider.

15. The dishwasher of claim 14 wherein the two upper slide assemblies and the two lower slide assemblies are positioned in the door for carrying the decorative cover.

* * * * *